US010415938B2

(12) United States Patent
Mohler et al.

(10) Patent No.: US 10,415,938 B2
(45) Date of Patent: Sep. 17, 2019

(54) PROPELLANT

(71) Applicant: Spectre Enterprises, Inc., Melbourne, FL (US)

(72) Inventors: Jonathan Mohler, Vero Beach, FL (US); Timothy Mohler, Vero Beach, FL (US); Daniel Yates, Melbourne, FL (US)

(73) Assignee: SPECTRE ENTERPRISES, INC., Melbourne, FL (US)

( * ) Notice: Subject to any disclaimer, the term of this patent is extended or adjusted under 35 U.S.C. 154(b) by 46 days.

(21) Appl. No.: 15/872,869

(22) Filed: Jan. 16, 2018

(65) Prior Publication Data

US 2019/0033045 A1 Jan. 31, 2019

Related U.S. Application Data

(60) Provisional application No. 62/446,747, filed on Jan. 16, 2017.

(51) Int. Cl.
*C06B 45/12* (2006.01)
*F42B 5/16* (2006.01)
(Continued)

(52) U.S. Cl.
CPC ..... *F42B 5/16* (2013.01); *C06B 45/12* (2013.01); *F42B 5/025* (2013.01); *F42B 5/10* (2013.01); *F42B 5/28* (2013.01); *F42B 5/285* (2013.01)

(58) Field of Classification Search
CPC ..... F42B 5/02; F42B 5/10; F42B 5/16; F42B 5/025; F42B 5/28; F42B 5/285; C06B 45/00; C06B 45/12
(Continued)

(56) References Cited

U.S. PATENT DOCUMENTS 1,920,075 A * 7/1933 Haenichen ..... F42B 5/16 102/284
2,131,352 A 9/1938 Marsh
(Continued)

FOREIGN PATENT DOCUMENTS

CA 2 273 335 A1 5/1999
FR 1605107 A 3/1973
(Continued)

OTHER PUBLICATIONS

International Search Report and Written Opinion for PCT/US18/13923, dated Oct. 1, 2018.
(Continued)

*Primary Examiner* — James S Bergin
(74) *Attorney, Agent, or Firm* — William F. Lang, IV; Lang Patent Law LLC

(57) ABSTRACT

A propellant in the form of a pellet includes adjoining pellet sections. Each pellet section includes a smokeless powder, a burnable metal, and a polymer. The smokeless powder in each pellet section will in many examples be different from the burn rate of the smokeless powder in other pellet sections. A nonignitable tube passes through the center of the pellet. When the pellet is used within a firearm cartridge, the ignition products from the primer travel through the non-burnable tube, igniting the pellet sections sequentially from the front to the rear of the cartridge. The pressure generated by the propellant within a cartridge casing can be maximized and controlled through the selection of the burn rate for each pellet section.

10 Claims, 5 Drawing Sheets

(51) Int. Cl.
*F42B 5/28* (2006.01)
*F42B 5/10* (2006.01)
*F42B 5/02* (2006.01)
*F42B 5/285* (2006.01)

(58) Field of Classification Search
USPC ..... 102/285–290; 149/14, 15
See application file for complete search history.

(56) References Cited

U.S. PATENT DOCUMENTS

| | | | | |
|---|---|---|---|---|
| 2,995,429 | A | | 8/1961 | Winiams et al. |
| 2,995,431 | A | | 8/1961 | Bice |
| 3,022,149 | A | | 2/1962 | Cramer |
| 3,122,884 | A | | 3/1964 | Grover et al. |
| 3,155,749 | A | | 11/1964 | Rossen et al. |
| 3,219,498 | A | | 11/1965 | Nitzsche et al. |
| 3,275,259 | A | | 9/1966 | Plungulan |
| 3,382,117 | A | | 5/1968 | Cook |
| 3,668,872 | A | | 6/1972 | Camp et al. |
| 3,711,344 | A | | 1/1973 | Pierce |
| 3,715,248 | A | | 2/1973 | Swotinsky et al. |
| 3,725,516 | A | | 4/1973 | Kaufman |
| 3,794,545 | A | | 2/1974 | Bertrand et al. |
| 3,808,061 | A | | 4/1974 | Pierce |
| 3,896,865 | A | | 7/1975 | Comfort et al. |
| 3,905,846 | A | | 9/1975 | Berta |
| 3,938,440 | A | | 2/1976 | Dooley et al. |
| 3,956,890 | A | | 5/1976 | Davis |
| 3,969,167 | A | | 7/1976 | Johannes |
| 4,115,999 | A | | 9/1978 | Diebold |
| 4,756,251 | A | | 7/1988 | Hightower, Jr. et al. |
| 4,875,948 | A | | 10/1989 | Verneker |
| 5,031,541 | A | * | 7/1991 | Gardner ..... F42B 5/16 102/430 |
| 5,076,868 | A | | 12/1991 | Doll et al. |
| 5,292,387 | A | | 3/1994 | Highsmith et al. |
| 5,320,043 | A | | 6/1994 | Andre et al. |
| 5,583,315 | A | | 12/1996 | Fleming |
| 5,589,661 | A | | 12/1996 | Menke et al. |
| 5,773,748 | A | | 6/1998 | Makowiecki et al. |
| 5,801,325 | A | | 9/1998 | Willer et al. |
| 5,854,439 | A | | 12/1998 | Almstrom et al. |
| 6,059,906 | A | | 5/2000 | Fleming et al. |
| 6,176,950 | B1 | | 1/2001 | Wood et al. |
| 6,334,394 | B1 | | 1/2002 | Zimmermann et al. |
| 6,364,975 | B1 | | 4/2002 | Fleming et al. |
| 6,599,379 | B2 | | 7/2003 | Hiskey et al. |
| 6,679,960 | B2 | | 1/2004 | Jones |
| 6,692,655 | B1 | | 2/2004 | Martins et al. |
| 6,713,177 | B2 | | 3/2004 | George et al. |
| 6,726,788 | B2 | | 4/2004 | Fleming et al. |
| 6,740,180 | B1 | | 5/2004 | Cesaroni |
| 6,843,868 | B1 | | 1/2005 | Fawls et al. |
| 6,913,661 | B2 | | 7/2005 | Fleming et al. |
| 7,770,380 | B2 | | 8/2010 | Dulligan et al. |
| 7,879,271 | B2 | | 2/2011 | Gangopadhyay et al. |
| 7,918,163 | B2 | | 4/2011 | Dahlberg |
| 7,921,777 | B2 | | 4/2011 | Dahlberg |
| 7,958,823 | B2 | | 6/2011 | Sawka |
| 7,998,290 | B2 | | 8/2011 | Sheridan et al. |
| 8,172,963 | B2 | | 5/2012 | Schroder |
| 8,202,377 | B2 | | 6/2012 | Erickson et al. |
| 8,361,257 | B2 | | 1/2013 | Schroder |
| 8,454,769 | B2 | | 6/2013 | Erickson et al. |
| 8,524,018 | B2 | | 9/2013 | Busky et al. |
| 8,544,387 | B2 | | 10/2013 | Dahlberg |
| 8,608,878 | B2 | | 12/2013 | Kellett et al. |
| 8,641,842 | B2 | | 2/2014 | Hafner et al. |
| 9,182,201 | B2 | * | 11/2015 | Coffman, II ..... F42B 5/16 |
| 2006/0011276 | A1 | | 1/2006 | Grix et al. |
| 2006/0278119 | A1 | | 12/2006 | Shilliday et al. |
| 2007/0099335 | A1 | | 5/2007 | Gangopadhyay et al. |
| 2007/0272112 | A1 | | 11/2007 | Nielson et al. |
| 2008/0047453 | A1 | | 2/2008 | Dahlberg |
| 2008/0134924 | A1 | | 6/2008 | Sawka |
| 2008/0152899 | A1 | | 6/2008 | Gangopadhyay et al. |
| 2009/0104575 | A1 | | 4/2009 | Shtatnov |
| 2011/0067789 | A1 | | 3/2011 | Grix et al. |
| 2011/0259230 | A1 | | 10/2011 | Sawka et al. |
| 2012/0009424 | A1 | | 1/2012 | Jelliss et al. |
| 2012/0103479 | A1 | | 5/2012 | Katzakian et al. |
| 2012/0145830 | A1 | | 6/2012 | Stevenson et al. |
| 2013/0305950 | A1 | | 11/2013 | Coffman, II |
| 2014/0137996 | A1 | | 5/2014 | Hafner et al. |
| 2016/0216095 | A1 | | 7/2016 | Rami |

FOREIGN PATENT DOCUMENTS

| | | | |
|---|---|---|---|
| GB | 190613764 | | 12/1908 |
| GB | 885409 | A | 12/1961 |
| GB | 987332 | A | 3/1965 |
| GB | 994184 | A | 6/1965 |

OTHER PUBLICATIONS

F. R. Freeman, Ammonium Nitrate as an Oxidant for Composite Propellants: Part I: Preliminary Considerations (1984).

R. B. Cole, Combustion of Solid Propellants at High Pressures—A Survey (1965).

Jesse J. Sabatini, Amita V. Nagori, Gary Chen, Phillip Chu, Reddy Damavarapu, and Thomas M. Klapotke, High-Nitrogen-Based Pyrotechnics: Longer- and Brighter- Burning, Perchlo.

Naminosake Kubota, Propellants and Explosives: Thermochemical Aspects of Combustion (2002).

Jesse J. Sabatini, Jay C. Poret, and Russell N. Broad, Use of Crystalline Boron as a Burn Rate Retardant toward the Development of Green-Colored Hand Held Signal Formulations.

M. Pandey, S. Jha, R. Kumar, S. Mishra, and R. R. Jha, The Pressure Effect Study on the Burning Rate of Ammonium Nitrate-HTPB-Based Propellant with the Influence Catalysts, 10.

M. Quinn Brewster, Todd A. Sheridan, and Atsushi Ishihara, Ammonium Nitrate-Magnesium Propellant Combustion and Heat Transfer Mechanism, 8 Journal of Propulsion and Power 760.

C. Oommen and S. R. Jain, Ammonium Nitrate: A Promising Rocket Propellant Oxidizer, 67 Journal of Hazardous Materials 253-281 (1999)(only the abstract is available).

Kyle Mizokami, "New Experimental Army Rifle Uses "Telescoped" Ammunition," Popular Mechanics, Sep. 28, 2016, https://www.popularmechanics.com/military/weapons/a23094/this-exper.

* cited by examiner

PROPELLANT

CROSS REFERENCE TO RELATED APPLICATION

This application claims the benefit of U.S. provisional patent application Ser. No. 62/446,747, which was filed on Jan. 16, 2017, and entitled "Propellant."

TECHNICAL FIELD

The present invention relates to propellants for firearms, other guns such as artillery pieces, missiles, torpedoes, and the like.

BACKGROUND INFORMATION

Propellants are commonly utilized to propel projectiles in a desired direction. Propellants typically burn to produce a gas. Increasing gas pressure serves to propel the projectile. In the case of firearms, a common propellant is smokeless powder, which may take the form of a single base, double base, or triple base powder (or more correctly, granular material). Single base powder comprises nitrocellulose. Double base powder utilizes nitrocellulose and nitroglycerin. Triple base powder utilizes nitrocellulose, nitroglycerin, and nitroguanidine. Various stabilizers may also be added to the gunpowder. The rate at which each of these powders burns is controlled in part by controlling the size of the granules. However, the resulting gas pressure typically reaches its maximum very quickly, and then rapidly decreases. Since pressure is decreasing while a projectile is still within the barrel of a gun, some opportunity to increase the velocity of the projectile is lost.

An example of a present propellant is U.S. Pat. No. 7,918,163, issued to J. Dahlberg on Oct. 1, 2013. This patent discloses a progressive propellant charge. This patent discloses nested cylindrical propellant sections, with each section having a different burn rate. Ignition starts in the innermost cylindrical section, having the slowest burn rate, and progresses outward, with successive outward sections having faster burn rates. U.S. Pat. No. 8,544,387 includes the same disclosure.

U.S. Pat. No. 6,692,655, which discloses a method of making a multi-base propellant from pellet size nitrocellulose. The method begins with nitrocellulose. The nitrocellulose is diluted in a non-solvent to form a slurry. A liquid elastomer precursor polymer is added in order to improve the mechanical properties at high and low temperatures. A thermal stabilizer is also added. The non-solvent is then removed from a slurry by heating. Plasticizers are added to the coated pellets, which in some cases may be energetic plasticizers. If a triple base propellant is desired, energetic solids are used in combination with the nitrocellulose and plasticizers. If a multi-base propellant is desired, then oxidizer particles and inorganic fuel particles can also be included. Oxidizers include ammonium perchlorate, ammonium nitrate, hydroxylammonium nitrate, ammonium dinitramide, potassium dinitramide, potassium perchlorate, or mixtures of the above. Fuels include aluminum, magnesium, boron, titanium, silicon, and mixtures thereof.

U.S. Pat. No. 8,454,769 discloses a non-toxic percussion primer. Magnesium is used as one possible fuel particle for the primary explosive, and an oxide coating on the Magnesium is preferred to reduce its sensitivity and reduce the need for an additional protective coating. Nitrocellulose is used as a secondary explosive. A dual acid buffer is used to reduce temperature induced onset of hydrolysis. The priming compound also includes tetracene as a sensitizer and glass powder as a friction generator. Oxidizers in the form of moderately active metal oxides are also included.

U.S. Pat. No. 8,202,377 discloses non-toxic percussion primers. This patent is very similar to the previously discussed patent.

U.S. Pat. No. 3,808,061 discloses a nitrocellulose solid propellant composition with a load additive to reduce radar attenuation. The propellant utilizes nitrocellulose with an energizing plasticizer that may be a nitrate ester such as nitroglycerin. A metallic fuel such as aluminum, boron, or magnesium may also be included. Alternatively, a nonexplosive plasticizer may be used. A stabilizer is also included. Powdered lead chromate is included in order to reduce the radar attenuation of the propellant.

U.S. Pat. No. 3,956,890 discloses a composite modified double base propellant with a metal oxide stabilizer. The metal may be magnesium, aluminum, tin, lead, titanium, or zirconium. Nitrocellulose or plasticized nitrocellulose is used as the binder. Nitroglycerin, triethyleneglycol dinitrate, and other plasticizers are disclosed as being known in the art.

U.S. Pat. No. 3,711,344 discloses the processing of cross-linked nitrocellulose propellants. The propellant may include a plasticizer, a stabilizer, a cross-linker, a metal fuel, and an organic or inorganic oxidizer. The metal fuel can be aluminum, zirconium, boron, beryllium, or magnesium.

U.S. Pat. No. 8,641,842 discloses a propellant composition including stabilized red phosphorus. The propellant composition is claimed to have a reduced peak pressure but higher average pressure as compared to other propellants. The red phosphorus is coated with a metal oxide in order to stabilize the red phosphorus, and to resist reactions with oxygen or water. The stabilized red phosphorus is then coated with a polymer such as a thermoset resin. The propellant further includes an energetic binder such as nitrocellulose, and an energetic plasticizer such as nitroglycerin. A carbon compound such as graphite may be included. The propellant may include at least one oxidizer which may be a nitrate compound, and at least one inorganic fuel such as a metal or metal oxide compound. Magnesium is one example of the inorganic fuel. Potassium sulfate may be included as a flash suppressor. A similar composition is disclosed in US 2014/0137996.

U.S. Pat. No. 6,599,379 discloses low smoke nitroglycerin and nitrocellulose-based pyrotechnic compositions. The composition includes an oxidizing agent. Ammonium perchlorate is the preferred oxidizer. Metal salts are added as flame coloring agents. Magnesium or other metal flakes or powders can be added to increase the temperature or light output for to produce a spark effects.

U.S. Pat. No. 3,905,846 discloses a composite modified double base propellant with metal oxide stabilizer. The propellants includes a binder of nitrocellulose and a plasticizer such as nitroglycerin. An oxidizer such as a perchlorate or nitrate is included. Ammonium perchlorate is the most preferred. The propellant includes a metal fuel such as aluminum, zirconium, lithium, or magnesium. Aluminum is the most preferred. An oxide of a metal from the group consisting of cadmium, magnesium, aluminum, tin, lead, titanium, or zirconium is included as a stabilizer.

U.S. Pat. No. 3,896,865 discloses a propellant with polymer containing nitramine moiettes as a binder. The use of magnesium and other metal fuels is also disclosed.

U.S. Pat. No. 3,715,248 discloses a castable metallic illuminant containing a fuel and oxidizer as well as a nitrocellulose plasticized binder. The metallic fuel is either magnesium or aluminum. The oxidizer is sodium or potassium nitrate.

U.S. Pat. No. 3,668,872 discloses a solid propellant rocket. The powdered fuel is selected from beryllium, boron, aluminum, magnesium, zirconium, titanium, lithium, silicon, aluminum borohydride, and the hydrides of any of these metals. Nitrocellulose is one of several possible binders. This fuel is contained within a pressure chamber within the rocket. A toroidal tank is arranged externally of the nozzle, and contains an alkane, alkene, or alkyne fuel. The fuel from the tank is injected into the expansion nozzle to mix with the combustion products.

U.S. Pat. No. 3,382,117 discloses a thickened aqueous explosive composition containing entrapped gas. The sensitizer may be TNT or a single base, double base (combination of nitroglycerin and nitrocellulose, or triple base smokeless powder. A triple base powder may include aluminum or other heat producing metals such as magnesium.

U.S. Pat. No. 2,131,352 discloses a propellant explosive. Powdered aluminum and magnesium are suggested for addition to smokeless powder for the purpose of speeding up the combustion of the smokeless powder.

U.S. Pat. No. 3,275,250 discloses a process for making fine particles of nitrocellulose. The process includes ball milling the nitrocellulose in either water or organic nonsolvent slurry. Fine sand is then used for light grinding and dispersing. Next, nitrocellulose is separated from the sand by screening.

GB 885,409 discloses fuel grains for rocket engines. The fuel is in the form of a consumable honeycomb structure, with a honeycomb material being inorganic sheet material such as polyethylene, polyurethane, polypropylene, or synthetic rubber which may or may not contain granular fuel fillers or additives such as powdered aluminum, lithium, boron, magnesium, or sodium. Alternatively, the honeycomb structure can be made from metal foils such as aluminum, magnesium, or lithium. The cell openings may be packed with oxidizer such as ammonium nitrate or sodium, potassium, lithium, or ammonium perchlorate.

Jesse J. Sabatini, Amita V. Nagori, Gary Chen, Phillip Chu, Reddy Damavarapu, and Thomas M. Klapotke, High-Nitrogen-Based Pyrotechnics: Longer- and Brighter-Burning, Perchlorate Free, Red-Light Illuminants for Military and Civilian Applications (2011) discloses a formula including 39.3% strontium nitrate, 29.4% to 35.4% magnesium, 14.7% PVC, and other minor ingredients.

U.S. Pat. No. 5,076,868 discloses a solid propellant composition producing halogen free exhaust. The propellant utilizes magnesium as a fuel and ammonium nitrate as an oxidizer. Hydroxy terminated polybutadiene (HTPB) is one possible binder. Polypropylene glycol is the preferred binder. Ammonium nitrate is provided at 40% to 70% by weight, magnesium is 16% to 36% by weight, and PPG is 10% to 25% by weight, with 12 to 18% by weight being preferred.

U.S. Pat. No. 5,320,043 discloses a low vulnerability explosive munitions element including a multi-composition explosive charge. The explosive includes an organic nitrate explosive within a polyurethane or polyester polymer matrix, with the organic nitrate explosive being about 20% by weight. A peripheral layer also utilizes a polyurethane or polyester polymer matrix containing an organic nitrate explosive, but at less than 17% by weight, and also containing a mineral oxidant. The peripheral layer may contain a reducing metal such as aluminum, zirconium, magnesium, boron, and their mixtures. A mineral oxidant such as ammonium perchlorate, potassium perchlorate, ammonium nitrate, sodium nitrate, and their mixtures may also be included.

U.S. Pat. No. 6,176,950 discloses an ammonium nitrate and paraffinic material based gas generating propellants. Ammonium nitrate is included as an oxidizer, and the paraffinic material is the fuel. Examples include paraffin wax, as well as polyolefins such as polyethylene, polypropylene, and polybutylene. Small quantities of magnesium stearate, potassium perchlorate, or RDX may also be included. The content is ignited by a crash sensor which closes an electrical circuit, igniting a small explosive charge that produces a heat flash sufficient to ignite the gas producing composition. One example includes 93% by weight ammonium nitrate, 6%. 5 paraffin wax, and 1% magnesium stearate. Other examples include 88% ammonium nitrate, 6% purified paraffin wax, 5% potassium perchlorate, and 1% magnesium stearate. The claims include specific percentages of each ingredient.

U.S. Pat. No. 5,801,325 discloses solid propellants for launch vehicles. The propellant is based on a polygycidyl nitrate elastomer binder, ammonium nitrate oxidizer, and aluminum or magnesium fuel. Nitroglycerin and nitrocellulose are both criticized as energetic binders. However, nitroglycerin is listed as a suitable plasticizer.

U.S. Pat. No. 3,155,749 discloses an extrusion process for making propellant grains. The process is adapted for casting and molding composite, polyvinyl chloride, plastisol propellants, such as propellants in which the polymeric fuel binder is polyvinyl chloride or a copolymer of vinyl chloride and vinyl acetate, in which the vinyl chloride is in major proportion. Organic plasticizers used with the propellants include butyl, octyl, glycol, and methoxy-methyl esters of phthalic, adipic, and sebacic acids, high molecular weight fatty acid esters, and the like. Metal powders can be suspended within the fuel, including Al, Mg, Be, Ti, and Si.

U.S. Pat. No. 2,995,429 discloses a solid composite rubber base ammonium nitrate propellant cured with metal oxide. The propellant is intended for use as a rocket fuel, and includes an oxidant such as ammonium nitrate, a burning rates catalyst such is Milori blue, and a copolymer of the conjugated diene and a heterocyclic nitrogen base that can be cured into a solid rocket fuel grain by the addition of zinc oxide or magnesium oxide. A reinforcing agent such as carbon black can also be included. Sodium nitrate is one of many other alternative oxidants.

U.S. Pat. No. 5,589,661 discloses a solid propellant based on phase stabilized ammonium nitrate. The ammonium nitrate is 35% to 80% of the propellant by weight, and is phase stabilized by chemical reaction with either copper oxide or zinc oxide. A binder polymer is 15% to 50% of the propellant by weight, and an energy rich plasticizer, as well as 0.2% to 5% burn moderator of the vanadium/molybdenum oxide as an oxide mixture and mixed oxide. The propellant may include 0.5% to 20% by weight metals such as aluminum, magnesium, or boron. The binder polymer can be inert. The energy rich plasticizers are chemically stable nitrate esters, nitro, nitroamino, or as azido plasticizers.

GB 987,332 discloses a propellant composition. The propellant is a polyvinyl chloride propellant having a solid oxidizer homogenously dispensed therethrough. The oxidizer can include ammonium perchlorate, sodium perchlorate, potassium perchlorate, sodium nitrate, or ammonium nitrate. Finally divided aluminum or magnesium is included within the propellant in a minor proportion by weight. The aluminum or magnesium has been found to increase the specific impulse and burning rate, while reducing the pressure exponent. Magnesium also results in reduced corrosion properties. About two parts polyvinyl chloride to three parts plasticizer, or a 1:1 ratio of these components, are used within the propellant. The oxidizer is about 75% by weight. About 5% to 16% of the propellant will be aluminum or magnesium.

U.S. Pat. No. 2,995,431 discloses a composite of ammonium nitrate propellant containing boron. The composite includes, out of 100 parts total composition, from 3.5 to 8 parts of the binder component that is a rubbery polymer, from 86 to 94 parts and ammonium nitrate oxidizer, from 0 to 5 parts a burning rates catalyst, and from 1 to 10 parts a finely divided high-energy additive of magnesium, mixture of boron and magnesium, or boron, or mixtures consisting of at least 50 weight percent of at least one of the above three ingredients with another finally divided metal of aluminum, beryllium, and lithium, or a mixture thereof. The high-energy additive preferably has a particle size of less than 50μ, with 20μ or even 10μ being preferred. The rubbery polymer includes polymers of olefins and diolefins such as polybutadiene, polyisobutylene, polyisoprene, copolymers of isobutylene and isoprene, copolymers of conjugated dienes and comonomers such as styrene, and copolymers of conjugated dienes and polymerizable heterocyclic nitrogen bases.

U.S. Pat. No. 3,725,516 discloses a mixing and extrusion process for solid propellants. The propellant is made from a copolymer of vinylidine fluoride and perfluoropropylene, an inorganic oxidizer such as ammonium perchlorate, potassium perchlorate, or ammonium nitrate, and a metal powders such as aluminum, beryllium, magnesium, or zirconium. The fluorocarbon binder is in the range of from 10% to 35% of the composition. The metal fuel is in the range from about 5% to 70% of the composition, and the oxidizer is in a range from about 25% to 75% of the composition. The ingredients are mixed with a solvent such as acetone with rapid stirring, and then air dried or oven dried before being compression molded or extruded into the desired shape.

U.S. Pat. No. 8,524,018 discloses a percussion primer composition. The composition includes a stabilized, encapsulated red phosphorus, an oxidizer, a secondary explosive composition, a light metal, and an acid resistant binder. The polymer layer may be epoxy resin, melamine resin, phenyl formaldehyde resin, polyurethane resin, or a mixture thereof. The oxidizer may be a light metal nitrate. The light metal (not part of the oxidizer) may include magnesium, aluminum, or a mixture thereof. The acid resistant binder may be polyester, polyurethane, or others.

U.S. Pat. No. 4,115,999 discloses the use of a high-energy propellants in gas generators. The propellant is 14% by weight carboxy terminated polybutadiene, 69% by weight ammonium perchlorate, and 17% by weight aluminum. Ammonium nitrate is listed as an alternative oxidizer. Nitroglycerin and nitrocellulose are listed as possible binders.

U.S. Pat. No. 6,364,975 is representative of a group of patents issued to W. C. Fleming et al. and assigned to Universal Propulsion Co., Inc. This patent discloses an ammonium nitrate propellant. The gas producing embodiments of the propellant are designed to be used in vehicle airbag restraint systems wherein gas production is paramount. The propulsive embodiments of the propellant are designed to be used in rockets and other munitions wherein energy output is paramount. The ammonium nitrate propellant includes a molecular sieve such as an aluminosilicate type molecular sieve. The molecular sieve is present from about 0.02% to about 6% by weight. Binders such as plastic elastomers and cure hardening materials may be included. Polyglycol adipate is the preferred binder. An energetic additive such as nice of nitroglycerin may be included. The energetic plasticizer is typically included in an amount from about 5% to about 40% by weight. Similar propellants are disclosed in U.S. Pat. Nos. 5,583,315, 6,059,906, 6,726,788, 6,913,661, and CA 2,273,335.

F. R. Freeman, Ammonium Nitrate as an Oxidant for Composite Propellants: Part I: Preliminary Considerations (1984) discloses the use of ammonium nitrate as an oxidizer.

FR 1605107 discloses solid propellants based on liquid comburants absorbed in powdered solids. Ammonium nitrate and aluminum are among the ingredients utilized, and polyurethane is a possible binder.

GB 994,184 discloses improvements in or relating to propellant grains. Metallic heat conductors are embedded within the propellants. The heat conductors effect rapid heat transfer from the combustion gases to the unburned propellant, resulting in more rapid burning than would be possible with heat transfer through the propellant itself. One propellant disclosed therein includes 12.44% polyvinyl chloride, 12.44% dibutyl sebacate, 74.63% ammonium perchlorate, and a 0.49% state stabilizer. Aluminum and magnesium can be used as the conductor.

Naminosake Kubota, Propellants and Explosives: Thermochemical Aspects of Combustion (2002) discloses the properties of numerous combustible materials.

U.S. Pat. No. 3,022,149 discloses a process for dispersing solids in polymeric propellant fuel binders. A polymer material and solid particles are dispersed in a nonsolvent, nonreactive vehicle such as ammonium perchlorate in n-heptane by mixing. Once the materials are mixed, they are allowed to stand and coalesce.

U.S. Pat. No. 3,122,884 discloses a rocket motor. The engine uses a semisolid monopropellant, for example, nitroglycerin gelled to a semisolid consistency by solution of nitrocellulose. A liquid fuel can be any oxidizable liquid. A solid oxidizer is also utilized. Metal powders such as aluminum or magnesium can be incorporated into the monopropellant.

U.S. Pat. No. 3,219,498 discloses organic acetylene polymers used as explosives.

U.S. Pat. No. 5,292,387 discloses phase stabilized ammonium nitrate. Stabilization is accomplished by adding at least one metal by nitrate amide salt.

Jesse J. Sabatini, Jay C. Poret, and Russell N. Broad, *Use of Crystalline Boron as a Burn Rate Retardant toward the Development of Green-Colored Hand Held Signal Formulations,* 29 Journal of Energetic Materials 360-368 (2011) discloses the formula sought to be modified included 46% by weight barium nitrate, 33% by weight magnesium, 16% by weight polyvinyl chloride, and 5% by weight Laminac 4116/Lupersol.

M. Pandey, S. Jha, R. Kumar, S. Mishra, and R. R. Jha, *The Pressure Effect Study on the Burning Rate of Ammonium Nitrate-HTPB-Based Propellant with the Influence Catalysts,* 107 Journal of Thermal Analysis and Calorimetry 135-140 (2012) disclosed the use of copper chromate as a catalyst for a propellant utilizing ammonium nitrate and HTPB.

M. Quinn Brewster, Todd A. Sheridan, and Atsushi Ishihara, *Ammonium Nitrate—Magnesium Propellant Combustion and Heat Transfer Mechanism,* 8 Journal of Propulsion and Power 760 (1992) discussed the heat transfer mechanisms both with and without magnesium.

C. Oommen and S. R. Jain, *Ammonium Nitrate: A Promising Rocket Propellant Oxidizer,* 67 Journal of Hazardous Materials 253-281 (1999) discloses the use of ammonium nitrate as a gas producing propellant.

U.S. Pat. No. 7,879,271 discloses a process for rapidly heating and cooling a target material without damaging the substrate upon which the target material has been deposited. Thermite in the form of fuel and oxidizer particles is deposited on the target material. The fuel and oxidizer particles are coated with a thin layer of a linker polymer. The polymer can include polyvinyl pyrrolidone, poly(4-vinyl pyridine), poly(2-vinyl pyridine), poly(ethylene imine), carboxylated poly(ethylene imine), cationic poly(ethylene glycol), grafted copolymers, polyaminde, polyether block amide, poly(acrylic acid), cross-linked polystyrene, poly (vinyl alcohol), poly(n-isopropylacrylamide), as well as others. The fuel and oxidizer particles are each coated separately. The fuel is preferably in the form of coated nanoparticles, and the oxidizer is in the form of coated nanorods. A sonication process is used to ensure that the molecular linker is removed from the nanoparticles and nanorods except the layer that is bound to the fuel or the oxidizer. Fuel nanoparticles and oxidizer nanorods are then placed in a solvent for another sonification process in which the fuel nanoparticles bind with oxidizer nanorods. The solution is then dried to obtain a nano composite. When ignited, the self-propagating reaction proceeds quickly enough to heat the target material without damaging the substrate. The process is intended to be used for heat treating amorphous materials in order to crystallize them. The process may also be utilized to alloy two or more metals. The polymer taught by this reference is used only as a binding material, not as an exothermic reaction enhancer or gas producer.

Various prior patents disclose combinations of thermite and various polymers for various purposes. For example, U.S. Pat. No. 8,361,257 discloses a laminated energetic device. The device includes thermite between a pair of polymer films. The polymer can be polyethylene terephthalate (PET), plastic films, polymer films, or metal foils. This patent specifically teaches that the polymer films do not catch fire from the thermite reaction. The energetic device remains sealed during and after the combustion of the low gas generating energetic mixture. The temperature of the energetic device immediately after the combustion is low enough that it can be safely held in the hand. The claims are directed towards a low gas generating energetic mixture that is deposited upon a core, which is then covered with a protective film for sealing the energetic mixture between the core and the film. One of the independent claims mentions a tubular core, while the other one mentions a cylindrical core. A similar device is disclosed by U.S. Pat. No. 8,172,963. Because the polymer coating taught by these patents is not consumed, it does not contribute to the exothermic reaction or to gas production.

U.S. Pat. No. 8,608,878 discloses a slow burning heat generating structure. The structure is intended to be used as a delay fuse for an explosive. The delay fuse includes a substrate, a coating disposed on the substrate, and a polymeric material surrounding the coated substrate. The substrate can be a metal mesh, with aluminum being preferred. Alternatively, the substrate can be foam or polymer having aluminum or other metals disposed therein. The coating can be nickel, palladium, alloys of either, or a nickel coating including material such as boron, phosphorus, or palladium. The substrate and coating are selected based on their melting point and density, as well as based on the formation enthalpy of their alloys. The materials are selected such that the alloying reaction between the materials is highly exothermic. A preferred example is an aluminum mesh coated in a nickel material. Subjecting the coated mesh to a match or heating element initiates the exothermic alloying reaction. The aluminum with nickel coating cannot, by itself, propagate in a self-sustained manner. The polymeric layer is a fluorinated or perfluorinated polymer, such as a floroelastomer, florosurfactant, fluorinated organic substance, etc. Polytetrafluoroethylene tape is one example of the polymeric layer. The polymeric layer reacts with the substrate or coating, and also may react with the alloyed material resulting from the alloying reaction. This reaction is also exothermic, providing the heat necessary to continue the reaction between the substrate and coating. This patent therefore teaches the use of a polymer to perpetuate a reaction that is intended to be slow burning and which would not be able to perpetuate itself in the absence of a polymer, and does not teach a combination with a polymer that would be a sufficient gas producer for use as a propellant.

US 2009/0104575 discloses the micro encapsulation of fuel for dosage heat release. Liquid fuel is encapsulated within a polymeric film containing metallic nanoparticles. Laser irradiation produces heat within the metallic nanoparticles to initialize burning of the fuel. The oxidizer must be supplied from external media, and could be permanganate dissolved water.

US 2012/0145830 discloses an incendiary capsule. The capsule includes a capsule body containing a pyrotechnic heat source in pellet form such as thermite. The first part of a two-part ignition system, such as potassium permanganate granules, is also contained within the capsule. The second part of the ignition system is injected into the capsule when the capsule is ready for use. The second part reacts with the potassium permanganate granules, causing an exothermic reaction which ignites the pyrotechnic heat source. The pyrotechnic heat source is covered with a liquid impervious material. The waterproof material can be a mixture of shellac and methylated spirits, or adhesive tape, or a capsule or container within which the pyrotechnic heat source is encased. The second ignition part can be glycol, which, when mixed with potassium permanganate, causes an exothermic reaction. The entire capsule body is made from a thin film of plastic material.

US 2012/0009424 discloses passivated metal nanoparticles having an epoxide-based oligomer coating. The invention is directed towards a variety of applications for medical or metal particles, including the use of aluminum particles in a thermite reaction, as well as the addition of aluminum to a liquid fuel such as diesel fuel. The goal is to passivate the aluminum without taking up the volume of space that is formed by an oxide layer around the aluminum, as well as the resulting delay in aluminum reactions. The nanoparticles may be coated with a polyethylene layer that may be oxygen-rich, but which prevents oxidation of the aluminum.

U.S. Pat. No. 6,713,177 discloses insulating and functionalizing fine metal containing particles with conformal ultrathin films. The purpose is to provide a coating for particulate ceramics and metals that preserves the bulk properties of the underlying substances while altering their surface properties, for example, making a reactive surface nonreactive, or a nonreactive surface reactive. Metal fuels are mentioned as one type of particle to be coated. The coatings deposited on the metal or ceramic particles are inorganic.

U.S. Pat. No. 3,794,535 discloses a pyrotechnic lacquer. The lacquer is a dispersion of a pyrotechnic composition in a colloidion. The pyrotechnic composition can be aluminum thermal powders, thermite powders, black powder, or powders based on zirconium, barium, chromate, ammonium perchlorate, or ammonium bichromate. The collodion contains either a powder based on nitrocellulose, on plasticized nitrocellulose, or on a mixture of nitrocellulose and nitroglycerin, dissolved in a volatile solvent such as ketone solvents, acetone, or methyl ethyl ketone, or a plastics material dissolved in an organic solvent, such as polyethylene dissolved in trichloroethylene, polyvinyl chloride dissolved in methyl ethyl ketone, or a cellulosic polymer disclosed in ethyl acetate. The lacquer is especially useful as an ignition composition for blocks of solid propellant.

GB 190613764 discloses a method of binding thermite into solid briquettes. The thermite is brought into solid formed by means of tragasanth or any other suitable binding material. The briquette is then coated with a thin layer of priming matter for the purpose of enclosing the thermite and to ignite the thermite when desired. The priming compound is a metallic peroxide and a solution of acetone and celluloid.

Accordingly, there is a need for a propellant that is capable of quickly reaching a predetermined maximum pressure, and maintaining a pressure that is substantially equal to the predetermined maximum pressure for substantially the entire time that the bullet is within the barrel of the firearm.

SUMMARY

The above needs are met by a propellant pellet. The pellet includes a first pellet section. The first pellet section has a first smokeless propellant powder having a first burn rate, a burnable metal adjacent to the first smokeless powder, and a polymer having a melting temperature below an ignition temperature of the first smokeless powder. The pellet further includes a second pellet section joined to the first pellet section. The second pellet section has a second smokeless propellant powder having a second burn rate, the second burn rate being faster than the first burn rate. The second pellet section also has a burnable metal adjacent to the second smokeless powder, and a polymer having a melting temperature below an ignition temperature of the second smokeless powder.

The above needs are further met by a firearm cartridge. The firearm cartridge includes a first pellet section. The first pellet section has a first smokeless propellant powder having a first burn rate, a burnable metal adjacent to the first smokeless powder, and a polymer having a melting temperature below an ignition temperature of the first smokeless powder. The firearm cartridge also includes a second pellet section that includes a second smokeless propellant powder having a second burn rate, the second burn rate being faster than the first burn rate. The second pellet section also has a burnable metal adjacent to the second smokeless powder, and a polymer having a melting temperature below an ignition temperature of the second smokeless powder. The firearm cartridge further includes a projectile secured adjacent to the first pellet section, and a primer secured adjacent to the second pellet section. A nonignitable tube extends from the primer to a position within the first pellet section. The nonignitable tube is structured to direct reaction products from the primer to the position within the first pellet section.

The above needs are additionally met by a method of making a propellant pellet. The method comprises providing a first smokeless powder, providing a burnable metal, providing a polymer, and providing a solvent. The first smokeless powder, burnable metal, and polymer are placed within the solvent, whereby the first smokeless powder, burnable metal, and polymer are combined. The solvent is removed. The combined first smokeless powder, burnable metal, and polymer are hot pressed into a pellet.

These and other aspects of the invention will become more apparent through the following description and drawings.

BRIEF DESCRIPTION OF THE DRAWINGS

Like reference characters denote like elements throughout the drawings.

DETAILED DESCRIPTION

Figure 1:
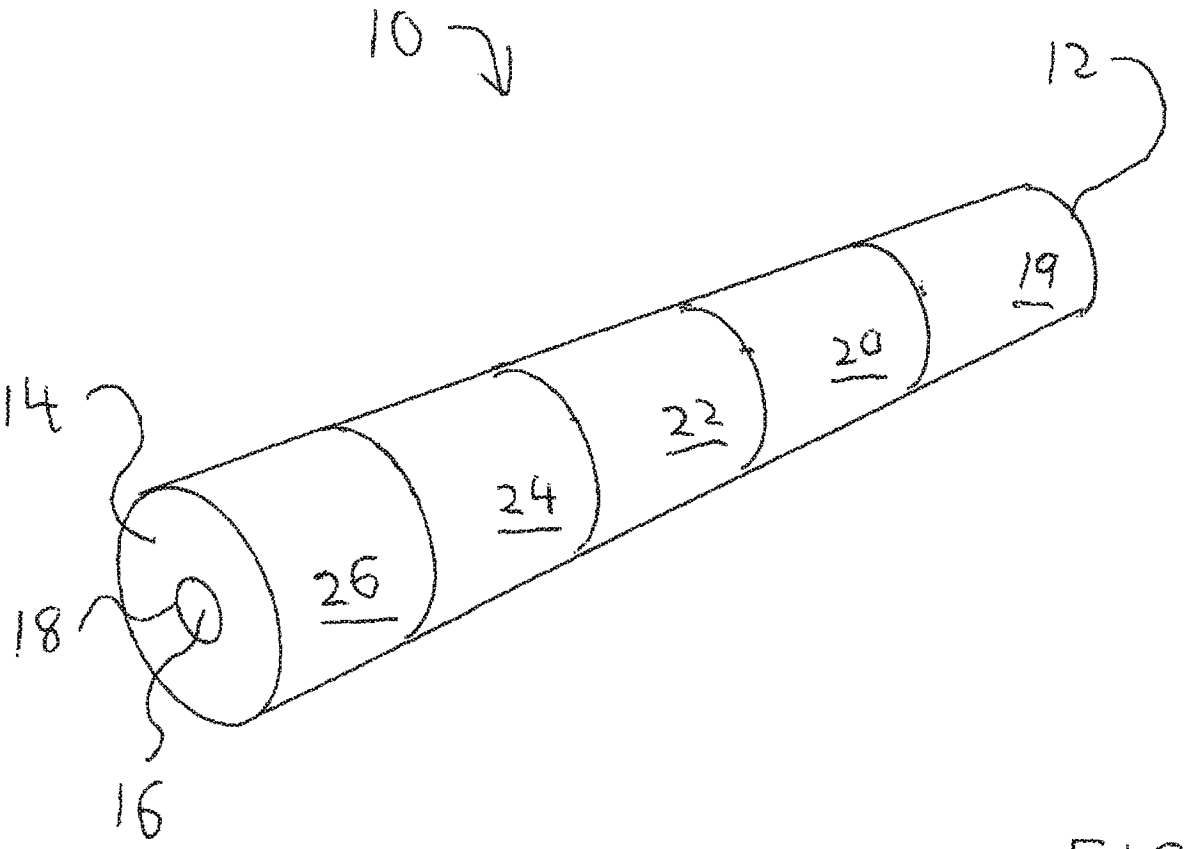
FIG. 1 is a perspective view of a propellant pellet.

Referring to the drawings, a propellant is illustrated. The propellant is a combination of either single base (nitrocellulose) or double base (nitrocellulose and nitroglycerin) smokeless powder; a burnable metal, for example, magnesium; and a low temperature thermoplastic, for example, ethylene vinyl acetate. The propellant is formed into a single pellet, which is ignited from one end, and burns to the other end in order to produce the desired gas. The composition of the propellant, and thus the burn rate of the propellant, may vary along the length of the pellet, as described in greater detail below. The shape of the pellet may also be structured to provide varying gas production along the length of the pellet during ignition, thus controlling the pressure generated as the pellet is ignited, in the manner described below in greater detail.

The pellet is made from a combination of a burnable metal such as magnesium, aluminum, boron, beryllium, or zirconium; nitrocellulose; and possibly nitroglycerin. The illustrated examples herein use magnesium as the burnable metal, because as compared to other burnable metals, magnesium has a lower hardness level, and therefore places less wear and tear on the interior of firearm barrels when used as an additive to a propellant. Other burnable metals, such as aluminum, may be used without departing from the scope of the invention. The primary purpose of the low temperature thermoplastic is to bind the propellant components into a single pellet having the desired shape, with the desired materials in the desired location along the length of the pellet. Ethylene vinyl acetate is an example of a suitable polymer, with one example being marketed by DuPont under the trademark ELVAX 410. Although binding the pellet together is the primary purpose of the polymer, the polymer does contribute to gas production as the pellet burns.

In the example of a single base propellant, magnesium will react with nitrocellulose as follows:

$$3Mg+2C_6H_{10}O_{10}N_3 \rightarrow 3MgO+6H_2O+3N_2+12CO$$

Thus, an example combination of magnesium and single base propellant, disregarding the polymer, should consist of about 10.9% magnesium and 89.1% nitrocellulose, +/−2%.

In the example of a double base propellant, disregarding the polymer, magnesium will react with nitrocellulose as shown above, and will react with nitroglycerin as follows:

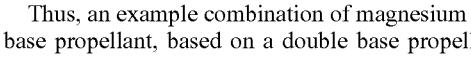

$$2C_3H_5N_3O_9+7Mg \rightarrow 6CO+5H_2O+3N_2+7MgO$$

Thus, an example combination of magnesium and double base propellant, based on a double base propellant having about 40% nitroglycerin, would include about 13% magnesium, 52% nitrocellulose, and 35% nitroglycerin. Double base propellants having different proportions of nitrocellulose and nitroglycerin may be used, with the percentages of nitrocellulose, nitroglycerin, and magnesium varying accordingly. Other burnable metals will react similarly during ignition of the propellant, so the portions of ingredients for other variations of the propellant can be similarly determined.

The ethylene vinyl acetate, or other polymer, will typically form about 2% of the total combination. Since the above formulas and compositions are based on the combination of smokeless powder and magnesium only, without taking the polymer into account, a slightly higher percentage of nitroglycerin and/or nitrocellulose would be used in conjunction with the polymer in order to provide a source of oxygen for burning the polymer during ignition of the propellant. The additional nitrocellulose or nitroglycerin required would be calculated using the chemical reaction caused by the burning of the polymer, and then supplying a sufficient amount of nitroglycerin or nitrocellulose to supply a sufficient amount of oxygen to complete the chemical reaction for the amount of polymer provided.

The magnesium or other burnable metal, as well as the ethylene vinyl acetate or other polymer, are added to the single base or double base smokeless powder by placing the powder within a solvent along with the burnable metal and polymer. An example of a suitable solvent is cyclohexane. When the solvent is removed, for example, by evaporating the solvent, the result is smokeless powder particles with a burnable metal and polymer coating.

The resulting particles can then be hot pressed into a desired configuration at a temperature below the ignition temperature of the propellant. For example, if ELVAX 410 is the polymer used, then the resulting particles can be hot pressed at a temperature of about 70° C. The results of the hot pressing process is a single propellant pellet having the desired configuration.

Other methods of making the propellant can include adding only the single base or double base powder, as well as the polymer, to the solvent. After the solvent has been removed, the burnable metal can be added in a powder form, and the resulting mixture can be hot pressed into the desired shape. As another alternative, if the single base or double base powder, burnable metal, and polymer are all in the form of a powder, they can be hot pressed directly into the desired configuration.

Such a single propellant pellet can be configured to provide varying burn rates along its length. Presently available single base and/or double base smokeless powders are already designed to have specific burn rates, through controlling of the particle size as well is the specific chemical composition. These powders can be arranged into a single pellet as illustrated in FIG. 1. The illustrated example of the pellet 10 is generally cylindrical in shape, having a tapered configuration with a narrow front end 12 and a wide back end 14. A passageway 16, which in the illustrated example is substantially coaxial with the pellet 10, has been molded within the pellet 10. At least the back end 18 of the central passageway 16 is open.

Smokeless powders having different burn rates have been incorporated into different sections of the pellet 10. In the illustrated example, the section having the slowest burning rate is at the front end 12 of the pellet 10, with increasing burn rates progressing towards the back end 14 of the pellet 10. Thus, in the illustrated example of a pellet 10 having five sections with different burn rates, forwardmost section 19 has the slowest burn rate. Section 20, which is adjacent to section 18, has a faster burn rate than section 18. Section 22, which is adjacent to section 20, has a faster burn rate than section 20. Section 24, which is adjacent to section 22, has a faster burn rate than section 22. Section 26, the rearmost section, has the fastest burn rate.

In the illustrated example of a pellet 10, the pressure generated by ignition of the pellet 10 is controlled not only by the burn rate of the smokeless powder component used in the individual sections, but also by the relative diameter of each section as compared to the adjacent sections. Thus, a smaller diameter section, resulting in less propellant material within that section, will be used to generate a lower pressure, and a larger diameter section, which will have more propellant material within that section, will be used to generate a higher pressure. In the illustrated example, the front end 12 of the pellet 10 will not only generate the slowest burn rate, but also the lowest overall pressure. As both burn rate and propellant volume increase as burning progresses rearward within the pellet 10, progressively greater pressure is generated.

Figure 2:
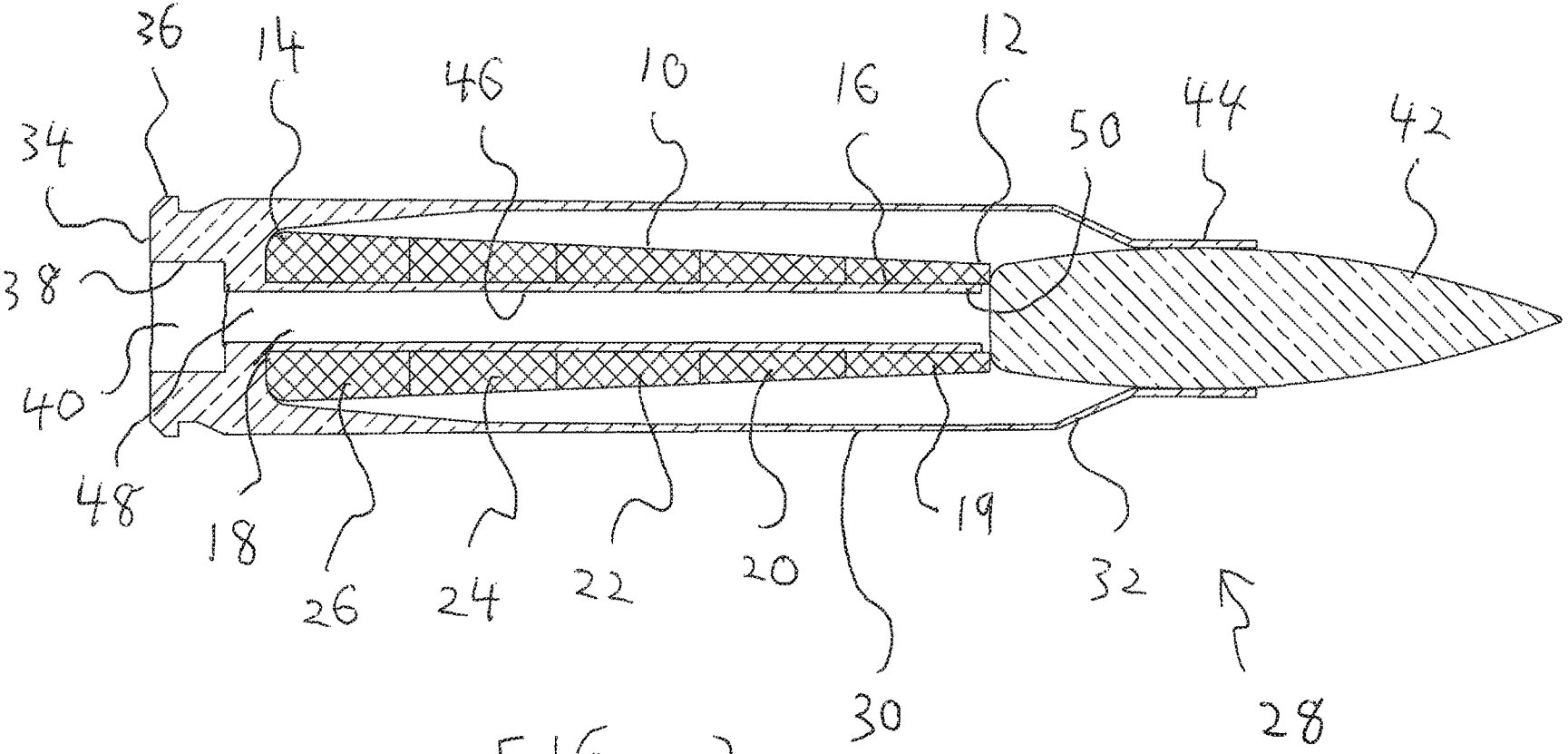
FIG. 2 is a side cross-sectional view of a cartridge for a firearm containing the propellant pellet of FIG. 1.

FIG. 2 illustrates a firearm cartridge utilizing a propellant pellet 10. The firearm cartridge 28 is conventional in many respects, utilizing a casing 30 having a side wall 32, a back end 34 defining a rim 36 and primer pocket 38 containing a primer 40, and a bullet 42 secured at the front end 44 of the casing 30. The casing 30 in the illustrated example is made from brass, but in other examples may be made from another metal such as a soft steel, aluminum, aluminum alloy, or a polymer material. Some examples of the casing 30 may include a back end 34 that is a separate piece from the side wall 32 at least during manufacture of the cartridge, permitting the pellet 10 to be inserted into the casing from the back end 34. A tube 46 made from a non-burning material, for example, brass, extends from the forward end 48 of the primer pocket 38, through the passageway 16, and terminates at a forward end 50 adjacent to the front end 12 of the pellet 10. Thus, when the primer 40 is ignited, the ignition products travel through the tube 46, igniting the pellet 10 first within the forward most section 18. Ignition of the pellet 10 then progresses sequentially through sections 20, 22, 24, and 26.

Figure 3:
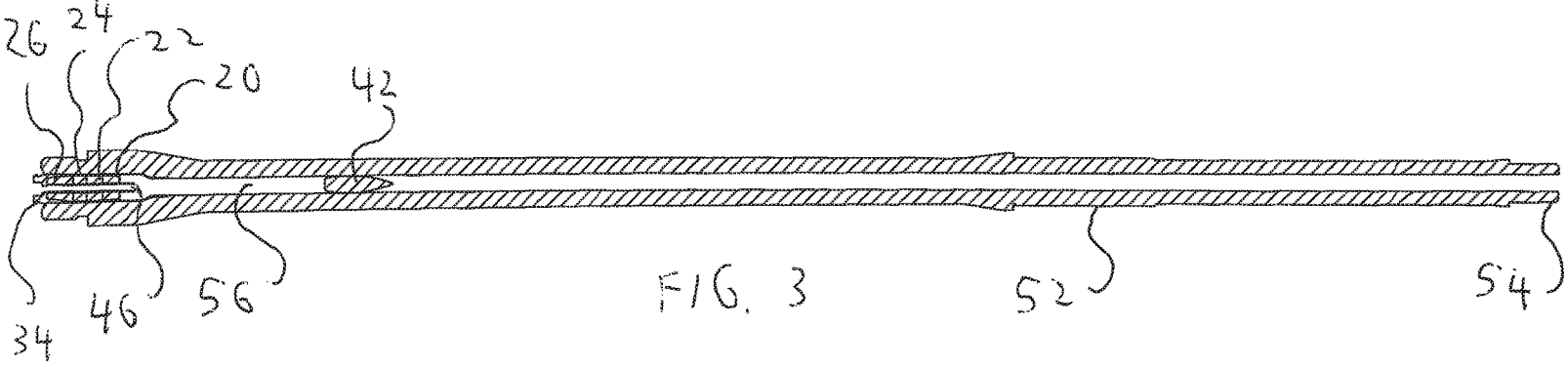
FIG. 3 is a side partially cross sectional view of a cartridge being discharged within the barrel of a firearm.
Figure 4:
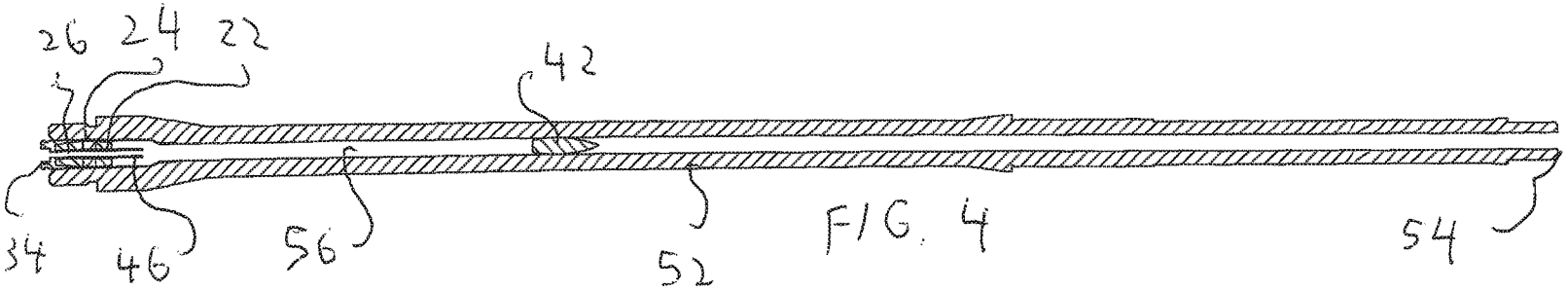
FIG. 4 is a side partially cross sectional view of a cartridge being discharged within the barrel of a firearm.
Figure 5:
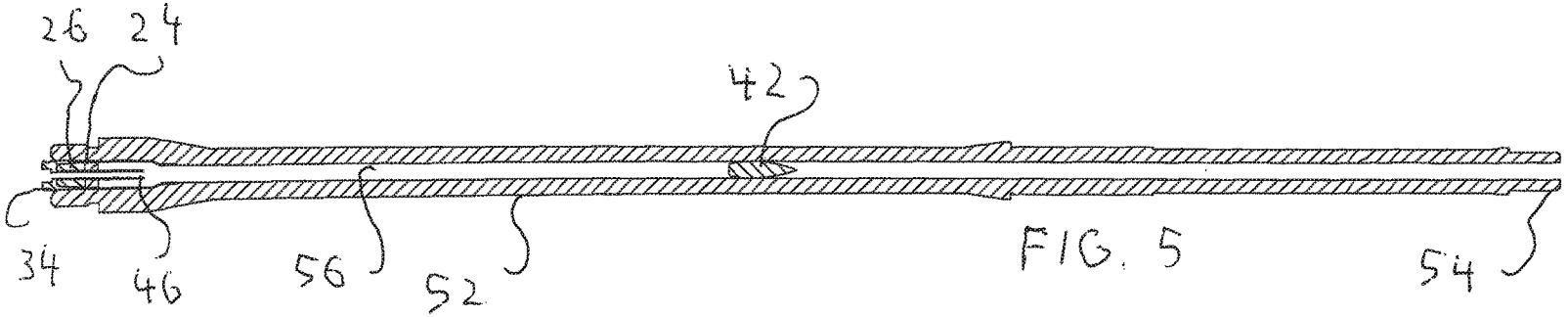
FIG. 5 is a side partially cross sectional view of a cartridge being discharged within the barrel of a firearm.
Figure 6:
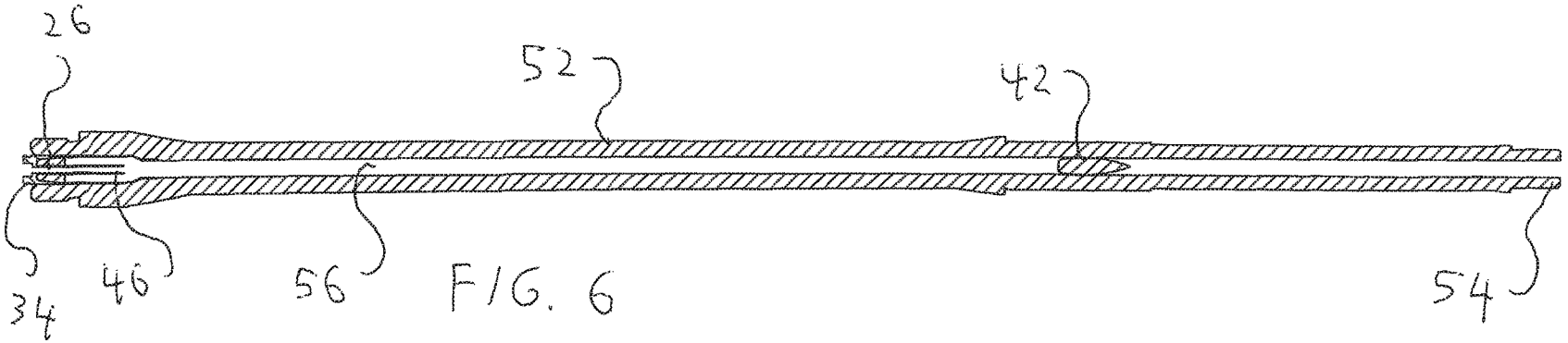
FIG. 6 is a side partially cross sectional view of a cartridge being discharged within the barrel of a firearm.
Figure 7:
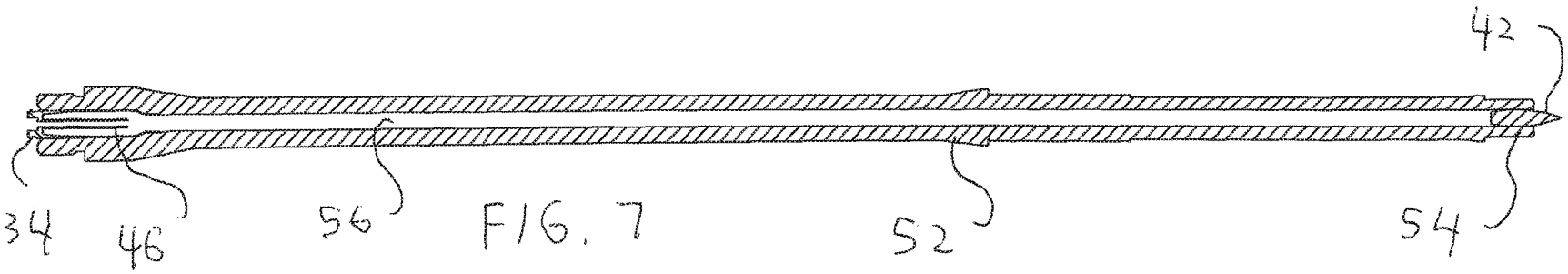
FIG. 7 is a side partially cross sectional view of a cartridge being discharged within the barrel of a firearm.

FIG. 3 illustrates the beginning stage of ignition, wherein the primer has ignited the propellant section 19. This section, containing the smallest diameter of the slowest burning powder, burns, generating gas to raise the pressure to a predetermined maximum pressure, forcing the bullet 42 forward within the barrel 52. As the bullet 42 progresses down the barrel 52, additional volume of space 56 behind the bullet 42 is available for the expanding gases. To maintain a pressure that is near the maximum predetermined pressure within the available space, the propellant section 20, containing a slightly greater amount of a faster burning propellant, is ignited from the burning of section 19, as shown in FIG. 4. As the bullet progresses farther down the barrel as shown in FIG. 5, leaving behind even more volume 56 to be filled by the expanding gases, propellant section 22 burns. Because section 22 contains a slightly greater amount of an even faster burning propellant, pressure is maintained at or near the predetermined maximum pressure. The process continues in FIG. 6, wherein the volume 56 left behind by farther bullet travel is filled by gas from the ignition of propellant section 24, which contains a slightly greater volume of even faster burning propellant. As the bullet approaches the muzzle 54, as shown in FIG. 7, propellant section 26 is ignited. Since propellant section 26 contains the largest diameter of the fastest burning propellant, the maximized volume 56 within the barrel 52 behind the bullet 42 is filled sufficiently to maintain the pressure at or near the predetermined maximum pressure until the bullet exits the muzzle.

Figure 8:
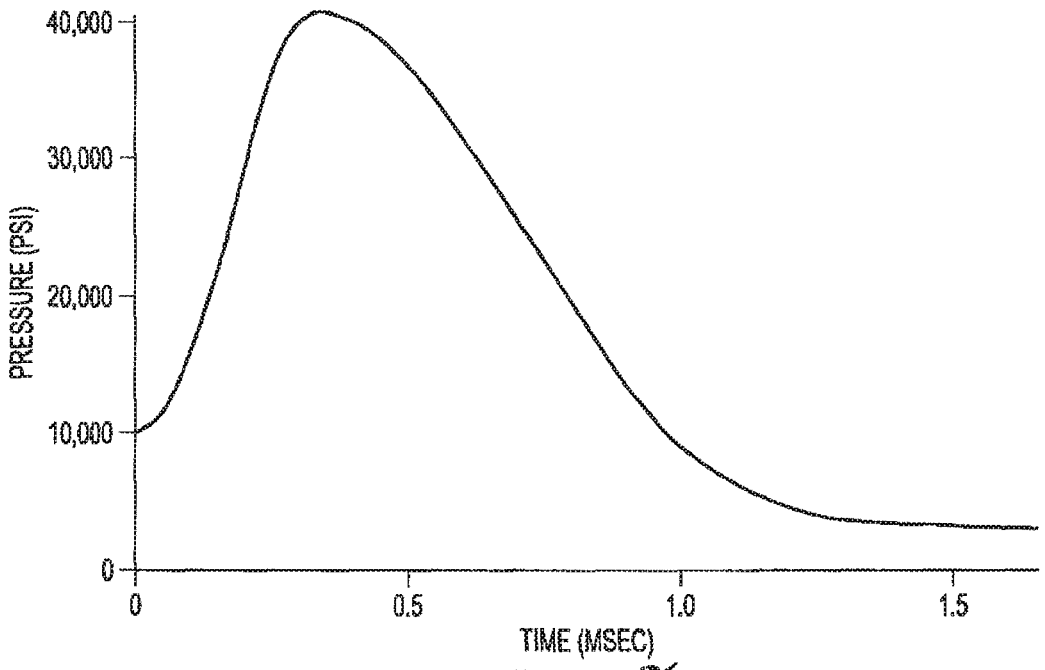
FIG. 8 PRIOR ART
FIG. 8 is a graph showing a pressure curve generated by a prior art propellant.
Figure 9:
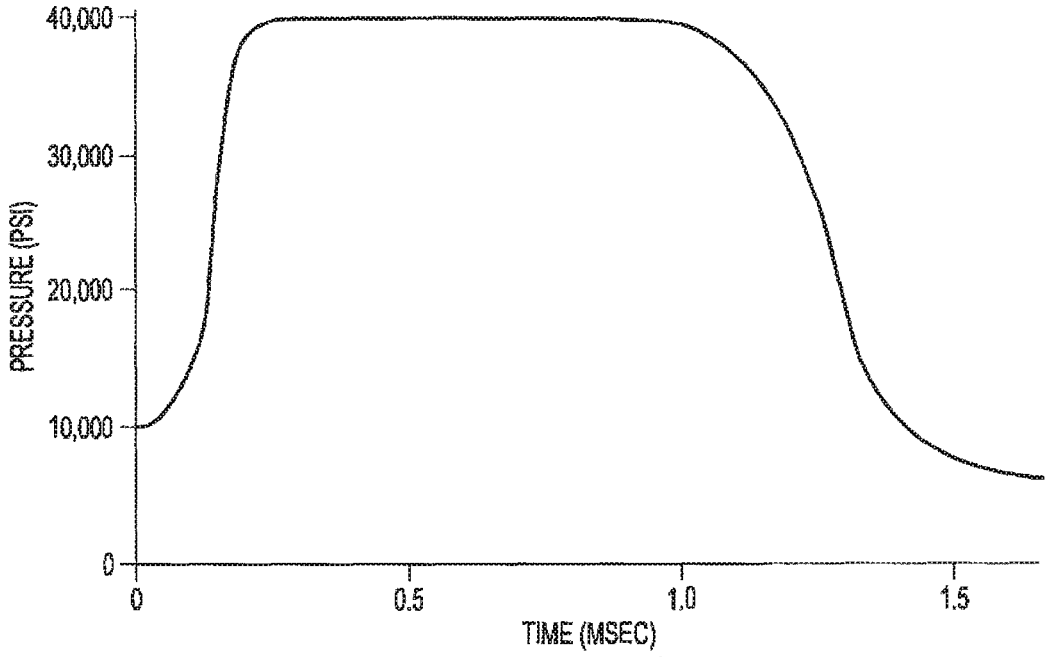
FIG. 9 is a graph showing a pressure curve that is obtainable utilizing a propellant pellet of FIG. 1.

As explained above, the use of progressively increasing amounts of progressively faster burning powders as the bullet travels farther down the barrel maintains the pressure level behind the bullet near the maximum safe pressure level, without exceeding the safe pressure level. Thus, increased velocity and energy is imported to the bullet without exceeding the safe pressure limits of the firearm. FIG. 8 illustrates a pressure curve generated by a presently available smokeless powder within a conventional firearm casing. As can be seen, the pressure reaches its maximum quickly, remains at the maximum for a relatively short time, and gradually decreases as the bullet progresses down the length of the barrel. As the pressure decreases, an opportunity to increase the velocity and energy of the bullet is lost. FIG. 9 illustrates a pressure curve that can be generated by a pellet 10. It is anticipated that the inclusion of magnesium or other burnable metals as described herein can increase the energy output of the propellant pellet 10 by about 80%.

The number of sections, specific polymer and burnable metal coated smokeless powder used within each section, and the diameter of each section (which would vary the amount of propellant within each section) can be varied to produce a variety of pressure curves. As few as one section, or several sections, may be utilized depending on the desired pressure curve. In some examples, a generally cylindrical pellet having a uniform diameter may be utilized. In other examples, the diameter may vary uniformly or nonuniformly along the length of the pellet, depending upon the desired pressure at various points in the ignition cycle. The direction of taper may be from a narrow front to a wide rear in some examples or from a wide front to a narrow rear in other examples. In other examples, the direction of taper may be nonuniform. Although the examples illustrated herein are generally cylindrical or tapered cylindrical, other shapes, for example, rectangular, may be utilized without departing from the invention. The shape of the pellet may in some examples conform to the interior of a cartridge casing, thus maximizing the available propellant. As another example, propellant blocks such as square propellant blocks could be used, combining them to produce a desired pressure curve. The individual ignition cycle, and thus the pressure generated, can thus be varied and customized in order to optimize the performance of each individual caliber of ammunition with which the propellant described herein is utilized. If, for example, a given firearm includes a gas port in a given location within the barrel, the pellet 10 can be configured so that an increased amount of faster burning propellant is ignited after the bullet passes the gas port, thus compensating for gases that flow into the gas port. Although the illustrated example commences ignition from the front of the pellet, ignition may be commenced from the rear of the pellet without departing from the invention.

The propellant described herein provides for significantly increased energy, with a smaller volume of propellant. As one example, a combination of single base smokeless powder, magnesium, and ethylene vinyl acetate will produce about 22% more energy than a propellant consisting solely of single base smokeless powder. As another example, a combination of double base smokeless powder, magnesium, and ethylene vinyl acetate will produce about 100% more energy than a propellant consisting solely of double base smokeless powder. A propellant pellet as described above may have up to 100% more density than loose powder. The propellant may therefore be utilized in applications wherein volume available for propellant is limited. If a pellet is structured to vary the burn rate throughout ignition to produce a pressure curve that maintains without exceeding a predetermined maximum pressure, additional energy may be transferred to a bullet as compared to the same pressure generated by presently available smokeless powder. Because the predetermined pressure level can be controlled as described above, the propellant may not only be used with presently available brass, aluminum, or steel cased ammunition, but also with other less common, or yet to be developed casing materials, such as plastic or polymer.

A variety of modifications to the above-described embodiments will be apparent to those skilled in the art from this disclosure. Thus, the invention may be embodied in other specific forms without departing from the spirit or essential attributes thereof. The particular embodiments disclosed are meant to be illustrative only and not limiting as to the scope of the invention. The appended claims, rather than to the foregoing specification, should be referenced to indicate the scope of the invention.

What is claimed is:

1. A propellant pellet, comprising:

a first pellet section, comprising:

a first smokeless propellant powder having a first burn rate, the first smokeless propellant powder comprising a plurality of particles;

a burnable metal adjacent to the first smokeless powder particles;

a polymer adjacent to the first smokeless powder particles or the burnable metal, the polymer having a melting temperature below an ignition temperature of the first smokeless powder;

a second pellet section joined to the first pellet section, the second pellet section, comprising:

a second smokeless propellant powder having a second burn rate, the second smokeless propellant powder comprising a plurality of particles, the second burn rate being different than the first burn rate;

a burnable metal adjacent to the second smokeless powder particles;

a polymer adjacent to the second smokeless powder particles or the burnable metal, the polymer having a melting temperature below an ignition temperature of the second smokeless powder; and a passageway extending through the second pellet section and at least a portion of the first pellet section.

2. The propellant pellet of claim 1, wherein the burn rate of the second smokeless powder is faster than the burn rate of the first smokeless powder.

3. The propellant pellet of claim 2, further comprising a nonignitable tube extending through the passageway and completely through the second pellet section to a position within the first pellet section.

4. The propellant pellet of claim 1, further comprising a nonignitable tube extending through the passageway and completely through the second pellet section to a position within the first pellet section.

5. The propellant pellet according to claim 1, wherein the burnable metal is magnesium.

6. A firearm cartridge, comprising:

a propellant pellet, comprising:

a first pellet section, comprising:

a first smokeless propellant powder having a first burn rate, the first smokeless propellant powder comprising a plurality of particles;

a burnable metal adjacent to the first smokeless powder particles;

a polymer adjacent to the first smokeless powder particles or the burnable metal, the polymer having a melting temperature below an ignition temperature of the first smokeless powder;

a second pellet section, the second pellet section, comprising:

a second smokeless propellant powder having a second burn rate, the second smokeless propellant powder comprising a plurality of particles, the second burn rate being different than the first burn rate;

a burnable metal adjacent to the second smokeless powder particles;

a polymer adjacent to the second smokeless powder particles or the burnable metal, the polymer having a melting temperature below an ignition temperature of the second smokeless powder;

a projectile secured adjacent to the first pellet section;

a primer secured adjacent to the second pellet section; and a nonignitable tube extending from the primer to a position within the first pellet section, the nonignitable tube defining an interior and an exterior, the first pellet and second pellet being disposed at the exterior of the nonignitable tube, the nonignitable tube being structured to direct reaction products from the primer to the position within the first pellet section.

7. The propellant pellet of claim 6, wherein the burn rate of the second smokeless powder is faster than the burn rate of the first smokeless powder.

8. The firearm cartridge according to claim 6, further comprising a casing, the casing defining a front portion a back portion, and an interior, the primer being secured within the back portion, the projectile being secured to the front portion, the first pellet, second pellet, and nonignitable tube being disposed in the interior of the casing.

9. The firearm cartridge according to claim 8, wherein the burnable metal is magnesium.

10. The propellant pellet according to claim 6, wherein the burnable metal is magnesium.

* * * * *